US008774699B2

(12) United States Patent
Kobayashi et al.

(10) Patent No.: US 8,774,699 B2
(45) **Date of Patent: *Jul. 8, 2014**

(54) SHEET FEEDER AND IMAGE FORMING APPARATUS

(75) Inventors: Shun Kobayashi, Kanagawa (JP); Aki Ikeda, Kanagawa (JP); Yoshikuni Ishikawa, Tokyo (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 144 days.

This patent is subject to a terminal disclaimer.

(21) Appl. No.: 13/404,410

(22) Filed: Feb. 24, 2012

(65) Prior Publication Data

US 2012/0230745 A1 Sep. 13, 2012

(30) Foreign Application Priority Data

Mar. 10, 2011 (JP) ..... 2011-053065

(51) Int. Cl.
*B65H 3/18* (2006.01)
*B65H 3/04* (2006.01)

(52) U.S. Cl.
CPC . *B65H 3/18* (2013.01); *B65H 3/047* (2013.01)
USPC ..... 399/388; 271/10.06; 271/18.2; 271/34; 400/629

(58) Field of Classification Search
CPC ..... B65H 3/04; B65H 3/047; B65H 3/18
USPC ..... 399/388; 271/34, 18.1, 18.2, 10.06; 400/629; 74/29, 89.18, 109
See application file for complete search history.

(56) References Cited

U.S. PATENT DOCUMENTS

| | | | | |
|---|---|---|---|---|
| 5,322,269 | A * | 6/1994 | Fukube et al. | 271/18.1 |
| 2010/0296852 | A1 | 11/2010 | Higaki | |
| 2011/0227275 | A1* | 9/2011 | Poh et al. | 271/18.1 |

FOREIGN PATENT DOCUMENTS

| | | | | |
|---|---|---|---|---|
| CN | 101891069 | A | 11/2010 | |
| JP | 04251041 | A | 9/1992 | |
| JP | 2003237962 | A | 8/2003 | |
| JP | 2004026314 | A | 1/2004 | |
| JP | 2010037047 | A | 2/2010 | |
| JP | 2010126317 | A | 6/2010 | |
| WO | WO-2010061895 | * | 6/2010 | B65H 3/18 |

OTHER PUBLICATIONS

Chinese Office Action dated Apr. 2, 2014 for corresponding Chinese Application No. 201210056855.7.

* cited by examiner

*Primary Examiner* — Daniel J Colilla
*Assistant Examiner* — Blake A Tankersley
(74) *Attorney, Agent, or Firm* — Harness, Dickey & Pierce, P.L.C.

(57) ABSTRACT

A sheet feeder includes an attraction separation unit including an attraction belt facing the upper surface of a stacked sheet bundle to attract an uppermost sheet thereof, and rotatably supported by a support member at a position upstream of the attraction belt in a sheet feeding direction; and a swing device for swinging the attraction separation unit around the support member as a fulcrum to move the attraction belt between an attraction position and a feed position more distant from the sheet bundle than the attraction position is. The swing device includes a first drive transmitting portion attached to a downstream end portion of the attraction separation unit and a second drive transmitting portion attached to the body of the sheet feeder and connected with the first drive transmitting portion. The first drive transmitting portion and the rack connect to swing the attraction separation unit.

13 Claims, 8 Drawing Sheets

SHEET FEEDER AND IMAGE FORMING APPARATUS

CROSS-REFERENCE TO RELATED APPLICATION

This patent application is based on and claims priority pursuant to 35 U.S.C. §119 to Japanese Patent Application No. 2011-053065, filed on Mar. 10, 2011 in the Japanese Patent Office, the entire disclosure of which is hereby incorporated by reference herein.

FIELD OF THE INVENTION

The present invention relates to a sheet feeder and an image forming apparatus.

BACKGROUND OF THE INVENTION

As a method of separating and feeding stacked sheets, such as documents and recording sheets, there is an electrostatic attraction separation method of generating an electric field on an attraction belt and bringing the attraction belt into contact with a sheet to attract and separate the sheet from other sheets.

A background sheet feeder according to the electrostatic attraction separation method includes an attraction separation unit that includes an attraction belt formed by a dielectric member wound around two rollers, a charger for supplying alternating charge to the attraction belt, and a holder holding the attraction belt and the charger. The holder rotatably supports the two rollers, and is fixed to a rotary shaft provided upstream of the rollers in the sheet feeding direction. One end of the rotary shaft is provided with a gear mechanism including a rack and pinion and a swing mechanism serving as a swing device for swinging the attraction separation unit. Further, one of the two rollers disposed on the upstream side in the sheet feeding direction is supported by the holder to be movable in a direction perpendicular to the surface of a sheet bundle.

Prior to the sheet feeding operation, the attraction belt held by the holder via the two rollers is located at a position separated from the sheet bundle. To feed the uppermost sheet of the sheet bundle by separating the sheet from the other sheets, the attraction belt is first rotated and supplied with alternating charge. After the supply of the alternating charge to the attraction belt, the rotation of the attraction belt is stopped. Then, the swing mechanism is driven to swing the attraction separation unit toward the sheet bundle. According to this action, the attraction belt is brought into contact with the uppermost sheet of the sheet bundle to attract the uppermost sheet of the sheet bundle to the attraction belt. After the attraction of the uppermost sheet of the sheet bundle to the attraction belt, the swing mechanism is driven to swing the attraction separation unit in a direction separating from the sheet bundle. According to this action, the uppermost sheet attracted to the attraction belt is lifted by the attraction belt, and is separated from the second sheet. Then, the attraction belt is driven to rotate to feed the uppermost sheet attracted thereto.

In the background sheet feeder, however, the attraction separation unit is configured to be cantilever-supported by the rotary shaft disposed on the upstream side in the sheet feeding direction and serve as a support member. As a result, the downstream end of the attraction separation unit in the sheet feeding direction acts as a free end, and the attraction separation unit vibrates owing to backlash occurring in a gear meshing portion or by resilience of the attraction separation unit. The vibration of the attraction separation unit may cause the uppermost sheet attracted to the attraction belt to separate from the attraction belt. Particularly when the attraction separation unit is swung at relatively high speed to increase productivity, a load due to the inertia of the attraction separation unit is increased. Therefore, it is desirable that the attraction separation unit be reduced in weight. If the attraction separation unit is reduced in weight, however, the above-described vibration becomes more pronounced.

In the background sheet feeder, a rack gear is attached to the rotary shaft serving as a fulcrum of the attraction separation unit. Therefore, a portion for transmitting drive to the attraction separation unit, i.e., a meshing portion between the rack gear and a pinion gear, is located near the rotary shaft serving as the fulcrum of the attraction separation unit. By contrast, the centroid of the attraction separation unit is located on the downstream side in the sheet feeding direction. Therefore, the distance from the gear meshing portion serving as the point of effort in the principle of the lever to the rotation shaft serving as the fulcrum is less than the distance from the centroid of the attraction separation unit serving as the point of load in the principle of the lever to the rotary shaft serving as the fulcrum. As a result, the torque for swinging the attraction separation unit is increased. The increase in the torque leads to an increase in size of a motor for operating the attraction separation unit and the sheet feeder. Further, a relatively large load is imposed on the gear meshing portion, and thus the gears of the swing device are worn away prematurely.

SUMMARY OF THE INVENTION

The present invention describes a novel sheet feeder. In one example, a novel sheet feeder includes an attraction separation unit and a swing device. The attraction separation unit includes an attraction belt stretched around two tension rollers, disposed facing the upper surface of a stacked sheet bundle to attract an uppermost sheet of the sheet bundle and rotatably supported by a support member at a position upstream of the attraction belt in a sheet feeding direction. The swing device swings the attraction separation unit around the support member as a fulcrum to move the attraction belt back and forth between an attraction position for attracting the uppermost sheet of the sheet bundle to the attraction belt and a feed position for feeding the uppermost sheet attracted to the attraction belt further from the sheet bundle than the attraction position. The swing device includes an assembly of a first drive transmitting portion and a second drive transmitting portion. The first drive transmitting portion is attached to a downstream end portion of the attraction separation unit in the sheet feeding direction. The second drive transmitting portion is attached to the body of the sheet feeder and connected with the first drive transmitting portion. The first drive transmitting portion and the second drive transmitting portion connect with each other to swing the attraction separation unit.

An upstream one of the two tension rollers in the sheet feeding direction may be movable in a direction perpendicular to the upper surface of the sheet bundle.

The attraction separation unit may include a bracket configured to rotatably support the tension rollers and a downstream end portion of the bracket in the sheet feeding direction forms the first drive transmitting portion.

One of the first drive transmitting portion and the second drive transmitting portion may form a rack, and the other one of the first drive transmitting portion and the second drive transmitting portion may form a pinion. The pinion may receive drive force of a drive source transmitted thereto.

The rack may be formed into a substantially circular arc shape centering around a position upstream of the first drive transmitting portion and the second drive transmitting portion in the sheet feeding direction.

The rack may be formed into a substantially circular arc shape centering around the fulcrum of the attraction separation unit.

The first drive transmitting portion may form the rack, and the second drive transmitting portion may form the pinion.

A connecting position between the first drive transmitting portion and the second drive transmitting portion may be disposed downstream of the centroid of the attraction separation unit in the sheet feeding direction.

The connecting position between the first drive transmitting portion and the second drive transmitting portion and the centroid of the attraction separation unit located at the feed position may be at the same position in the sheet feeding direction.

The assemblies of the first drive transmitting portion and the second drive transmitting portion may be provided to each of lateral opposite end portions of the attraction separation unit at lateral ends of the attraction belt.

Each assembly of the first drive transmitting portion and the second drive transmitting portion provided to each of lateral opposite end portions of the attraction separation unit at lateral ends of the attraction belt may be driven by a common drive source.

The second drive transmitting portion provided to the one of the lateral opposite end portions of the attraction separation unit in the width direction of the attraction belt and the second drive transmitting portion provided to the other one of the lateral opposite end portions of the attraction separation unit in the width direction of the attraction belt may be supported by a common rotary shaft disposed outside the range between the attraction position and the feed position of the attraction belt.

An upstream one of the two tension rollers in the sheet feeding direction may be immovable in a direction perpendicular to the upper surface of the sheet bundle.

The present invention further describes a novel image forming apparatus. In one example, a novel image forming apparatus includes an image forming device configured to form an image on a sheet and the above-described sheet feeder configured to separate an uppermost sheet from a stacked sheet bundle and feed the uppermost sheet to the image forming device.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
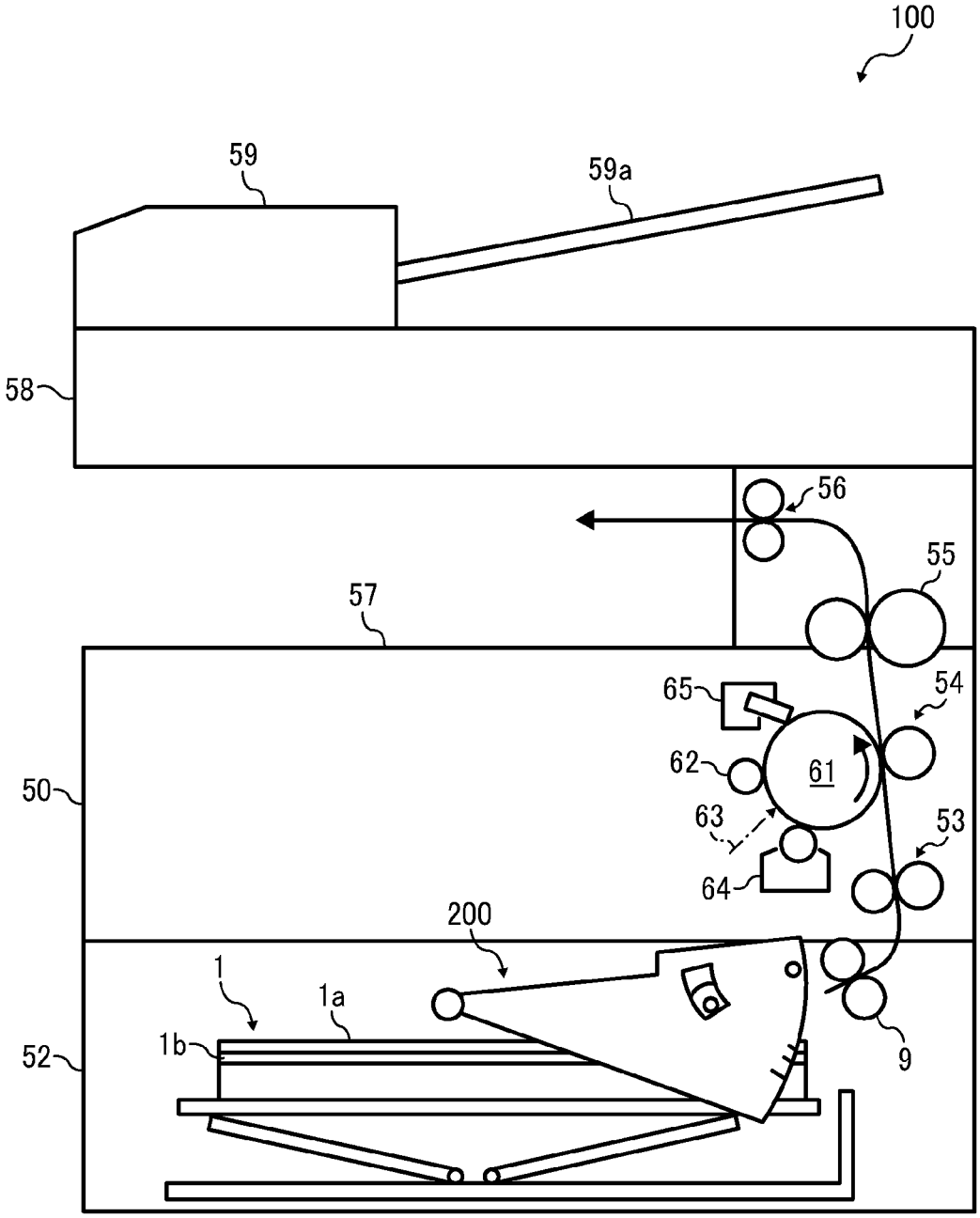
FIG. 1 is a schematic diagram illustrating a copier according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a description will be given of an embodiment of the present invention applied to a copier as an electrophotographic image forming apparatus. Needless to say, the present invention is not limited to the image forming apparatus of the present embodiment, and is also applicable to, for example, an image forming apparatus according to the inkjet method.

FIG. 1 is a schematic diagram illustrating a copier 100 according to the present embodiment. The copier 100 includes an automatic document feeder 59, a document reading unit 58, and an image forming unit 50. The automatic document feeder 59 separates a document from a document bundle loaded on a document tray 59*a*, and automatically feeds the document onto a contact glass on the document reading unit 58. The document reading unit 58 reads the document fed onto the contact glass by the automatic document feeder 59. The image forming unit 50 serves as an image forming device that forms an image on a recording medium sheet (hereinafter referred to as sheet) fed from a sheet feeding unit 52 on the basis of the document image read by the document reading unit 58. The sheet feeding unit 52 stores a sheet bundle 1 including a plurality of stacked sheets, and feeds from the sheet bundle 1 an uppermost sheet 1*a* at the uppermost position thereof to the image forming unit 50. In the present embodiment, the image forming unit 50 and the sheet feeding unit 52 are separable from each other.

The image forming unit 50 includes a photoconductor 61 serving as a latent image carrying member and surrounded by a charging device 62, a development device 64, a transfer device 54, a photoconductor cleaning device 65, and so forth. The image forming unit 50 further includes a not-illustrated optical writing unit for applying laser light 63 to the photoconductor 61 and a fixing device 55 for fixing a toner image on a sheet.

In the above-configured image forming unit 50, the outer circumferential surface of the photoconductor 61 is first uniformly charged by the charging device 62 in accordance with the rotation of the photoconductor 61. Then, the photoconductor 61 is applied with the laser light 63 by the not-illustrated optical writing unit on the basis of image data input from, for example, a personal computer or a word processor or image data of the document read by the document reading unit 58. According to this action, an electrostatic latent image is formed on the photoconductor 61. Thereafter, toner supplied by the development device 64 adheres to and visualizes the electrostatic latent image. According to this action, a toner image is formed on the photoconductor 61. By contrast, the sheet feeding unit 52 feeds each sheet by separating the sheet from the other sheets, and causes the sheet to come into contact with registration rollers 53 to be stopped. The sheet brought into contact with and stopped by the registration rollers 53 is then fed to a transfer unit, in which the photoconductor 61 and the transfer device 54 face each other, in proper timing with the formation of the toner image in the image forming unit 50. In the transfer unit, the toner image on the photoconductor 61 is transferred onto the supplied sheet. The sheet having the toner image transferred thereto is subjected to a toner image fixing process by the fixing device 55, and then is discharged to a sheet discharge tray 57 by a sheet discharging roller pair 56. By contrast, the surface of the photoconductor 61 after the transfer of the toner image is cleaned by the photoconductor cleaning device 65 to remove residual toner from the surface and prepare the photoconductor 61 for the next image forming operation. FIG. 1 also illustrates a feed roller pair 9, a sheet feeder 200, and a second sheet 1*b* of the sheet bundle 1, which will be described later.

Figure 2:
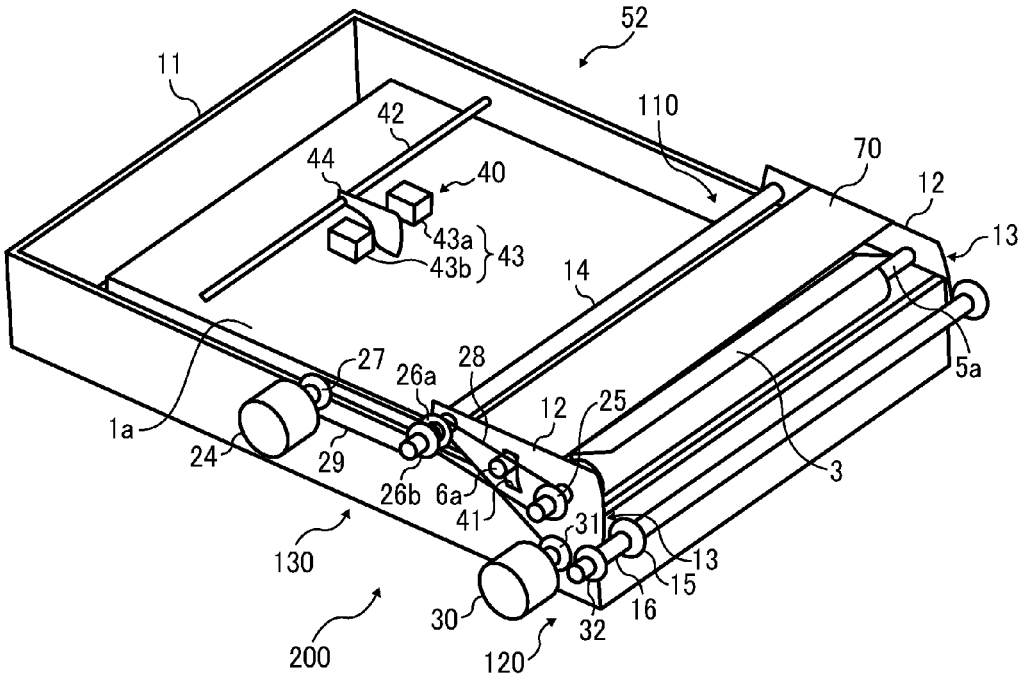
FIG. 2 is a perspective view illustrating a schematic configuration of a sheet feeding unit of the copier.
Figure 3:
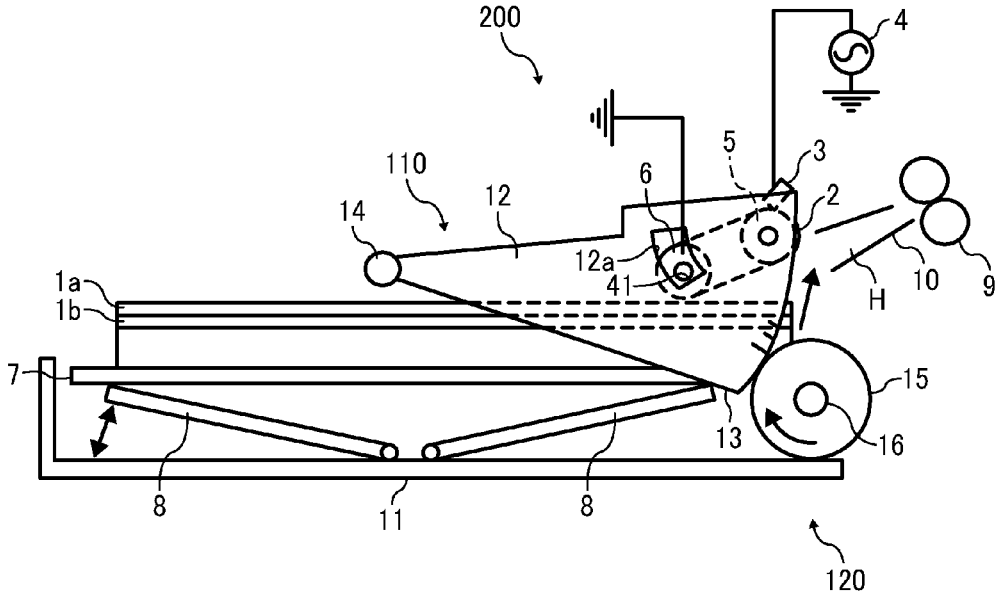
FIG. 3 is a schematic diagram illustrating a basic configuration of a sheet feeder provided in the sheet feeding unit.
Figure 4A:
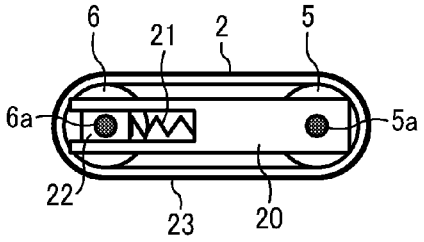
FIGS. 4A and 4B are diagrams illustrating side and plane views, respectively, of a configuration of main components of an attraction separation unit of the sheet feeder.
Figure 4B:
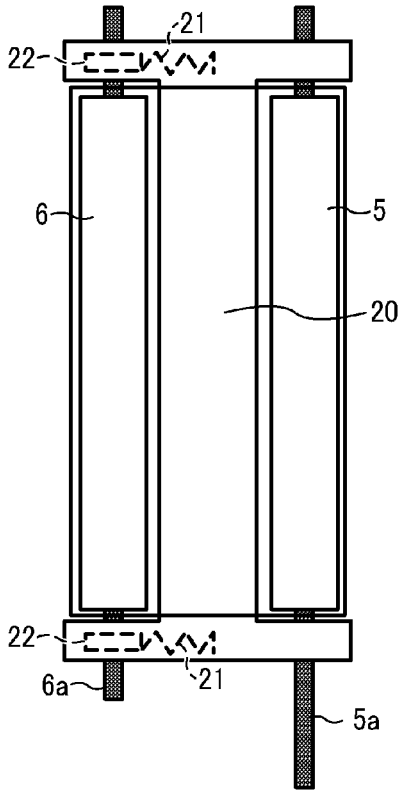

FIG. 2 is a perspective view illustrating a schematic configuration of the sheet feeding unit 52. FIG. 3 is a schematic diagram illustrating the sheet feeder 200. FIGS. 4A and 4B are diagrams illustrating a configuration of main components of an attraction separation unit 110 of the sheet feeder 200. The sheet feeding unit 52 includes a sheet feeding cassette 11 and the sheet feeder 200. The sheet feeding cassette 11 serves as a sheet material storing unit for storing a plurality of stacked sheets. The sheet feeder 200 separates and feeds, from the sheet bundle 1 including a plurality of sheets placed on the sheet feeding cassette 11, the uppermost sheet 1*a* at the uppermost position of the sheet bundle 1.

As illustrated in FIG. 3, the sheet feeding cassette 11 includes a bottom plate 7 for carrying the sheet bundle 1 of a plurality of stacked sheets loaded thereon. Support members 8 for supporting the bottom plate 7 are rotatably attached between the bottom plate 7 and a bottom portion of the sheet feeding cassette 11. Further, as illustrated in FIG. 2, the sheet feeding unit 52 is provided with a sheet detection device 40 that detects the arrival of the uppermost sheet 1*a* of the sheet bundle 1 to a predetermined position. The sheet detection device 40 includes a transmissive optical sensor 43 including a light receiving portion 43*a* and a light emitting portion 43*b* and a feeler 44 rotatably supported by a shaft 42 provided to the body of the sheet feeder 200. If the support members 8 are rotated by a not-illustrated drive motor to lift the bottom plate 7, the sheet bundle 1 loaded on the bottom plate 7 is lifted, and the uppermost sheet 1*a* comes into contact with the feeler 44. In this state, the light receiving portion 43*a* receives the light emitted from the light emitting portion 43*b* in the transmissive optical sensor 43. If the bottom plate 7 is further lifted, the feeler 44 blocks the light from the light emitting portion 43*b*, and prevents the light receiving portion 43*a* from receiving the light. According to this action, the arrival of the uppermost sheet 1*a* of the sheet bundle 1 to the predetermined position is detected, and the rotation of the support members 8 is stopped.

The sheet feeder 200 includes an attraction separation unit 110, a swing mechanism 120 serving as a swing device that swings the attraction separation unit 110, and a drive mechanism 130 that circularly moves an attraction belt 2 of the attraction separation unit 110. As illustrated in FIGS. 4A and 4B, the attraction separation unit 110 includes the attraction belt 2 stretched between a downstream tension roller 5 and an upstream tension roller 6. The attraction belt 2 has a two-layer structure including an outer layer and a conductive layer. The outer layer is made of polyethylene terephthalate having a resistance of approximately $10^8$ Ω·cm (ohm centimeters) or more and a thickness of approximately 50 μm. The conductive layer has a resistance of approximately $10^6$ Ω·cm or less, and is formed by aluminum vapor deposition. The above-described two-layer structure of the attraction belt 2 allows the conductive layer to be used as a grounded opposite electrode. Thus, an electrode member 3 connected to a charging power supply 4 in FIG. 3 and serving as a charging device that supplies charge to the attraction belt 2 is allowed to be provided at any position in contact with the outer layer of the attraction belt 2. Further, the inner surfaces of the opposite end edges of the attraction belt 2 are provided with ribs 23 for preventing meandering of the attraction belt 2. The ribs 23 engage with the opposite end surfaces of the downstream and upstream tension rollers 5 and 6 to prevent the attraction belt 2 from meandering.

The downstream tension roller 5 has an outer circumferential surface provided with a conductive rubber layer having a resistance value of approximately $10^6$ Ω·cm. The upstream tension roller 6 is a metal roller. The downstream tension roller 5 and the upstream tension roller 6 are both grounded. The downstream tension roller 5 has a relatively small diameter suitable for separating a sheet from the attraction belt 2 in accordance with the curvature thereof. That is, the diameter of the downstream tension roller 5 is set to a relatively small value to increase the curvature. According to this action, the sheet attracted to and fed by the attraction belt 2 separates from the downstream tension roller 5 and enters a feed path H (see FIG. 3) formed by guide members 10 disposed on the downstream side in the sheet feeding direction.

Further, as illustrated in FIGS. 4A and 4B, a shaft 5*a* of the downstream tension roller 5 is rotatably supported by a housing 20. A shaft 6*a* of the upstream tension roller 6 is rotatably supported by shaft bearings 22 held to be slidable in the sheet feeding direction relative to the housing 20. The shaft bearings 22 are biased by respective springs 21 toward the upstream side in the sheet feeding direction. According to this action, the upstream tension roller 6 is biased toward the upstream side in the sheet feeding direction, and applies tension to the attraction belt 2.

As illustrated in FIGS. 2 and 3, the opposite end portions of the attraction separation unit 110 in the width direction of the attraction belt 2 (hereinafter referred to as belt width direction) are respectively provided with brackets 12 for swingably holding the attraction belt 2. The brackets 12 are rotatably supported by a support shaft 14 provided upstream of the upstream tension roller 6 in the sheet feeding direction. With this configuration, the attraction separation unit 110 is swung by the later-described swing mechanism 120 around the support shaft 14 as a fulcrum between an attraction position for attracting the uppermost sheet 1*a* of the sheet bundle 1 to the attraction belt 2 and a feed position for feeding the uppermost sheet 1*a* attracted to the attraction belt 2.

The brackets 12 are respectively provided with slits 12*a*, and the shaft 6*a* of the upstream tension roller 6 passes through the slits 12*a*. According to this action, the upstream tension roller 6 is held to be movable relative to the brackets 12. By contrast, the shaft 5*a* of the downstream tension roller 5 passes through respective not-illustrated slits provided in the brackets 12. According to this action, the downstream tension roller 5 is held to be immovable relative to the brackets 12. As illustrated in FIG. 3, when the attraction separation unit 110 is located at the feed position, the shaft 6*a* of the upstream tension roller 6 is in contact with respective lower ends 41 of the slits 12*a*.

Each of the slits 12*a* provided in the brackets 12 is formed into a substantially circular arc shape centering around the rotation center of the downstream tension roller 5 to prevent a change in the distance between the rotation center of the upstream tension roller 6 and the rotation center of the downstream tension roller 5 regardless of the movement of the shaft 6*a* of the upstream tension roller 6 within the slits 12*a*. Consequently, the tension of the attraction belt 2 is unchanged by the movement of the shaft 6*a* of the upstream tension roller 6 within the slits 12*a*. Even if the tension of the attraction belt 2 is approximately 5 N (newtons) or less, it is normally possible to feed a sheet attracted to the attraction belt 2 by driving the attraction belt 2 to rotate, without causing a slip between the upstream and downstream tension rollers 6 and 5 and the attraction belt 2. In the sheet feeding under special condition, such as the feeding of a sheet having relatively high adhesive force, however, a slip may occur between the attraction belt 2 and the upstream and downstream tension rollers 6 and 5. It is therefore desired to increase the coefficient of friction of the respective surfaces of the upstream and downstream tension rollers 6 and 5 to suppress the occurrence of the slip.

Figure 5:
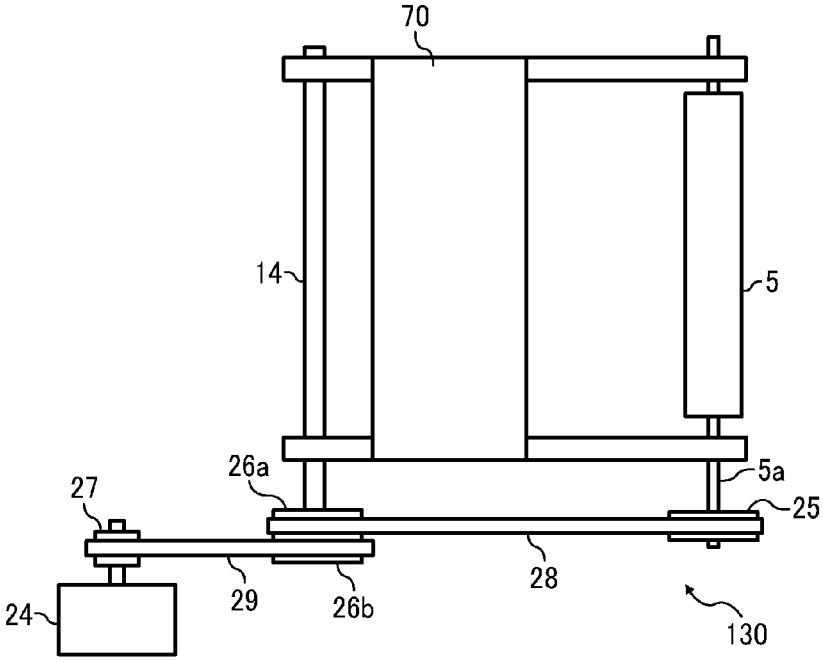
FIG. 5 is a schematic plan view of a drive mechanism of the sheet feeder.

FIG. 5 is a schematic configuration diagram of the drive mechanism 130 that drives the attraction belt 2 to rotate. The support shaft 14 rotatably supporting the brackets 12 has one end fixed with a first driven pulley 26*a* and a second drive pulley 26*b*. The downstream tension roller 5 has one end fixed with a second driven pulley 25. A driven timing belt 28 is wound around the first driven pulley 26*a* and the second driven pulley 25. Further, a drive motor 24 is provided upstream of the support shaft 14 in the sheet feeding direction. The drive motor 24 has a motor shaft fixed with a first drive pulley 27. A drive timing belt 29 is wound around the first drive pulley 27 and the second drive pulley 26*b*.

When the drive motor 24 is driven, the downstream tension roller 5 is driven to rotate via the drive timing belt 29 and the driven timing belt 28. According to this action, the attraction belt 2 is driven to rotate, and the upstream tension roller 6 is rotated in accordance with the rotation of the attraction belt 2 owing to the friction of the inner circumferential surface of the attraction belt 2. Further, in the present embodiment, the drive force of the drive motor 24 is transmitted to the downstream tension roller 5 via the support shaft 14 supporting the brackets 12. With this configuration, the attraction separation unit 110 swings around the support shaft 14 as a fulcrum, as described later, and thus the distance between the downstream tension roller 5 and the support shaft 14 is unchanged by the swing of the attraction separation unit 110. Accordingly, the tension of the driven timing belt 28 is maintained, and the drive force is favorably transmitted to the downstream tension roller 5.

Further, as illustrated in FIGS. 2 and 3, the swing mechanism 120 serving as the swing device that swings the brackets 12 is provided on the downstream side in the sheet feeding direction. The swing mechanism 120 includes rack gear portions 13 and pinion gears 15. Each of the rack gear portions 13 formed in a downstream end portion of the corresponding bracket 12 in the sheet feeding direction serves as a first drive transmitting portion. Each of the pinion gears 15 fixed to a rotary shaft 16 and meshing with the corresponding rack gear portion 13 serves as a second drive transmitting portion. The swing mechanism 120 further includes a swing motor 30. The rotary shaft 16 has one end provided with a driven gear 32 meshing with a motor gear 31 fixed to a motor shaft of the swing motor 30. With the swing motor 30 rotating the rotary shaft 16 fixed with the pinion gears 15, the pinion gears 15 are rotated. According to this action, the pinion gears 15 provided to the opposite end portions of the attraction separation unit 110 in the belt width direction are driven to rotate by the single swing motor 30. Consequently, the number of components is reduced, and thus the cost of the sheet feeder 200 is reduced. Further, the respective rack and pinions provided to the opposite end portions of the attraction separation unit 110 in the belt width direction are driven in synchronization by a relatively simple configuration.

The rack gear portions 13 have a substantially circular arc shape centering around the support shaft 14. During the swing of the attraction separation unit 110, the rack gear portions 13 formed in the brackets 12 swing around the support shaft 14. With the rack gear portions 13 formed into the substantially circular arc shape centering around the support shaft 14, therefore, the meshing between the rack gear portions 13 and the pinion gears 15 is maintained during the swing of the attraction separation unit 110. Further, with the rack gear portions 13 formed in the downstream end portions of the brackets 12 in the sheet feeding direction, the number of components is reduced and the configuration is simplified, as compared with a case where rack gears formed separately from the brackets 12 are attached to the brackets 12. Further, in the rack and pinions of the swing mechanism 120, the pinions (i.e., pinion gears 15) are provided to the body of the sheet feeder 200. Therefore, the configuration for transmitting the drive to the pinions is simplified, as compared with a case where the pinions are provided to the attraction separation unit 110.

When the swing motor 30 is driven, the pinion gears 15 are rotated, and the rack gear portions 13 move in a direction approaching or separating from the sheet bundle 1. According to this action, the brackets 12 swing around the support shaft 14 as a fulcrum.

The brackets 12 are connected and fixed by a reinforcing member 70. With the brackets 12 connected and fixed by the reinforcing member 70, the two brackets 12 are integrally swung. This configuration therefore suppresses twisting of the attraction belt 2 held by the brackets 12 during the swing of the brackets 12, and suppresses separation from the attraction belt 2 of the uppermost sheet 1*a* attracted thereto.

Figure 6:
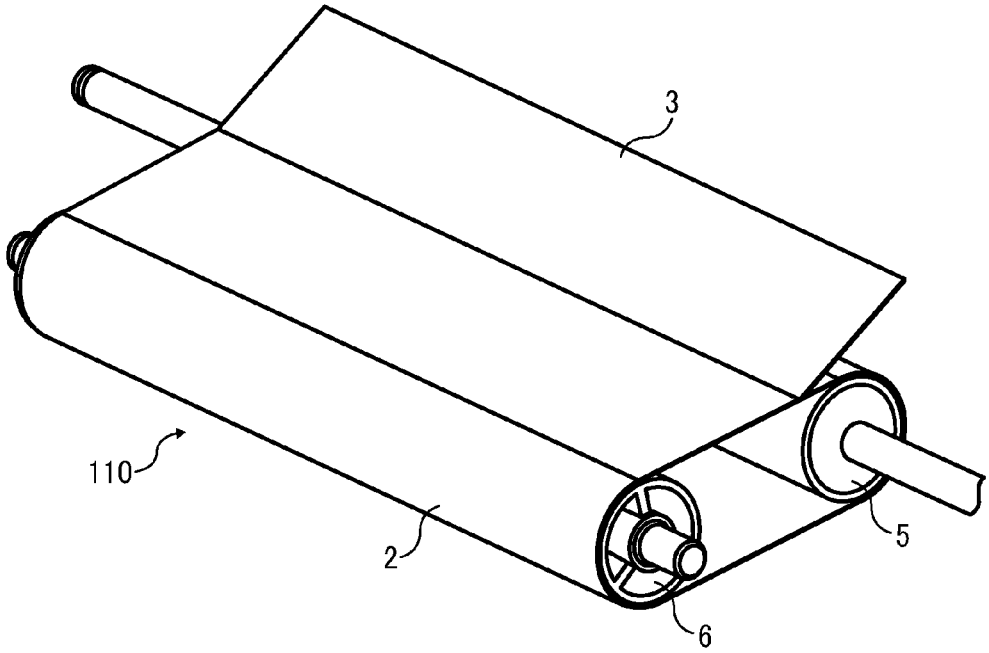
FIG. 6 is a perspective view illustrating a configuration of main components of the attraction separation unit.
Figure 7:
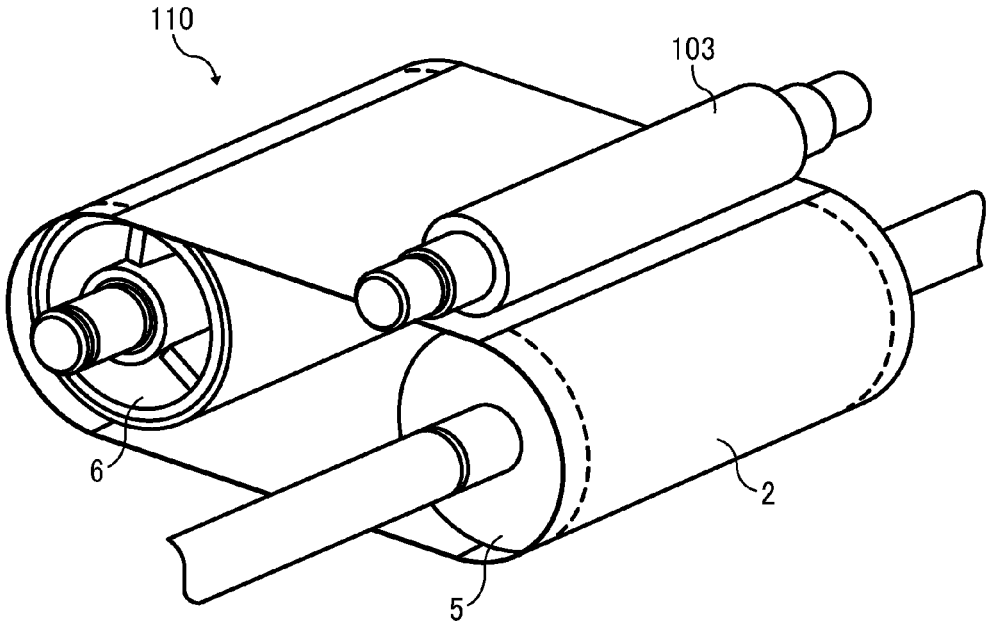
FIG. 7 is a perspective view illustrating a modified example of the attraction separation unit.

As illustrated in FIG. 6, the blade-like electrode member 3 serving as a charging device that charges the outer circumferential surface of the attraction belt 2 is in contact with the surface of the attraction belt 2. The electrode member 3 is connected to the charging power supply 4 that generates an alternating-current (hereinafter referred to as AC) voltage. With the electrode member 3 formed into a blade shape, it is relatively easy to reduce the pitch of alternating charging intervals, and stable charging is performed even if the attraction belt 2 has minute undulations. Although the present embodiment uses the blade-like electrode member 3 as the charging device, a roller-like electrode member 103 as illustrated in FIG. 7 may also be used as the charging device.

A sheet feeding operation using the sheet feeder 200 of the present embodiment will now be described with reference to FIGS. 8A to 8E.

Figure 8A:
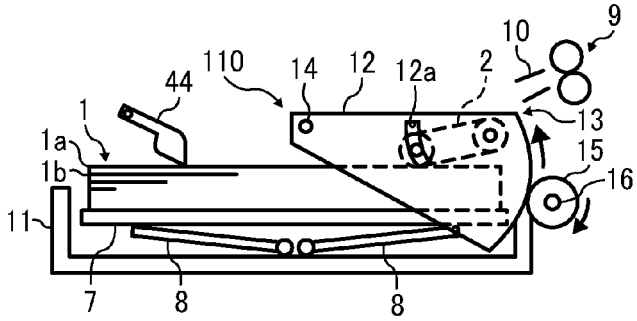
FIGS. 8A to 8E are diagrams illustrating separation and feeding of a sheet performed by the sheet feeder.

Normally, the bottom plate 7 is located at a lowered position, and the attraction separation unit 110 is located at the attraction position, as illustrated in FIG. 8A. Upon receipt of a sheet feeding signal, the swing motor 30 is first driven to drive the pinion gears 15 to rotate in the clockwise direction in the drawing. According to this action, the attraction separation unit 110 is swung around the support shaft 14 as a fulcrum in the counterclockwise direction in the drawing, i.e., the direction separating from the sheet bundle 1. Then, when the attraction separation unit 110 is swung to the feed position, the driving of the swing motor 30 is stopped.

Figure 8B:
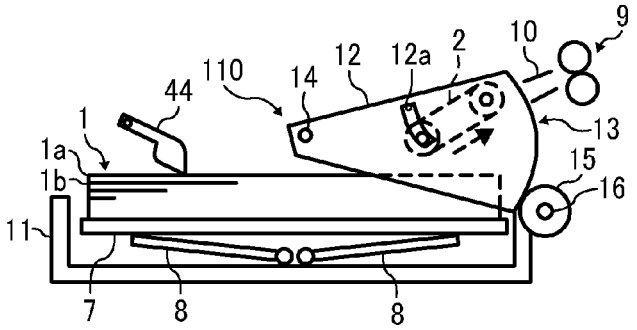

After the attraction separation unit 110 is stopped at the feed position, the drive motor 24 is driven to circularly move the attraction belt 2, as illustrated in FIG. 8B. Then, an alternating voltage is applied to the circularly moving attraction belt 2 by the charging power supply 4 via the electrode member 3. According to this action, charge patterns alternating with a pitch dictated by the frequency of the charging power supply 4 generating the AC voltage and the rotation speed of the attraction belt 2 are formed on the surface of the attraction belt 2. Preferably, the pitch is set to approximately 5 mm to approximately 15 mm. As well as the AC voltage, a direct-current (hereinafter referred to as DC) voltage alternated between high and low potentials may be provided by the charging power supply 4. The waveform of the voltage may be, for example, a rectangular or sine wave. In the present embodiment, the surface of the attraction belt 2 is supplied with a rectangular-wave voltage having an amplitude of approximately 4 kV (kilovolts).

Figure 8C:
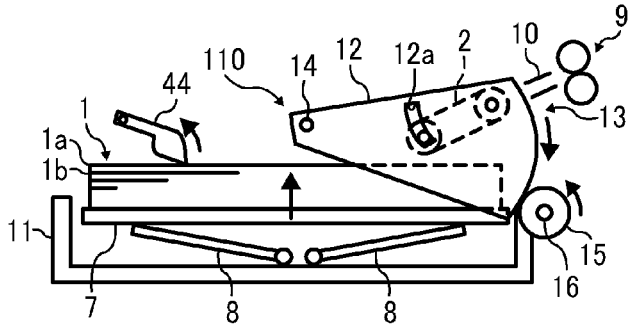

After the charging of the attraction belt 2 is completed, the rotation of the attraction belt 2 is stopped, and the bottom plate 7 standing by at the lowered position starts being lifted, as illustrated in FIG. 8C. Substantially at the same time, the swing motor 30 is rotated in the reverse direction to rotate the pinion gears 15 in the counterclockwise direction in the drawing. According to this action, the attraction separation unit 110 is swung around the support shaft 14 as a fulcrum in the clockwise direction in the drawing, i.e., a direction approaching the sheet bundle 1. As the bottom plate 7 is lifted and the attraction separation unit 110 is lowered, the uppermost sheet 1*a* of the sheet bundle 1 comes into contact with the upstream tension roller 6 via the attraction belt 2. If the bottom plate 7 is further lifted and the attraction separation unit 110 is further lowered, the upstream tension roller 6 is pushed upward by the sheet bundle 1. According to this action, the shaft 6*a* of the upstream tension roller 6 in contact with the lower ends 41 of the slits 12*a* is moved upward while being guided by the slits 12*a*. Further, the feeler 44 is rotated in the counterclockwise direction in the drawing in accordance with the lifting of the bottom plate 7. Then, upon arrival of the uppermost sheet 1*a* of the sheet bundle 1 to a predetermined position, the feeler 44 blocks the light from the light emitting portion 43*b* of the transmissive optical sensor 43. According to this action, the sheet detection device 40 detects the arrival of the uppermost sheet 1*a* of the sheet bundle 1 to the predetermined position, and the lifting of the bottom plate 7 is stopped. Further, the rotation of the swing motor 30 is stopped upon arrival of the attraction separation unit 110 to the attraction position. If the swing motor 30 is a stepper motor, the swing motor 30 is controlled on the basis of the angle of rotation corresponding to the number of pulses, thereby stopping the attraction separation unit 110 accurately at the attraction position. If the swing motor 30 is a DC motor, the swing motor 30 is controlled on the basis of the drive time, thereby stopping the attraction separation unit 110 accurately at the attraction position.

Figure 8D:
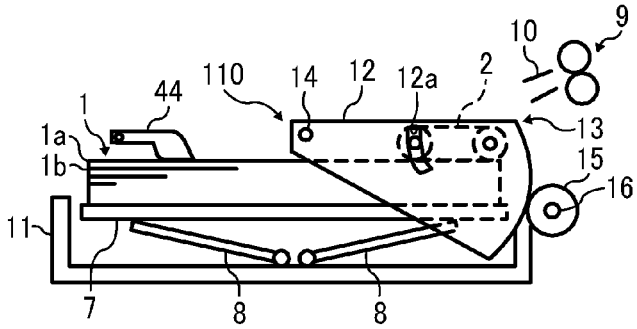

As illustrated in FIG. 8D, when the lifting of the bottom plate 7 and the lowering of the attraction separation unit 110 according to the swing thereof are stopped, an area of the attraction belt 2 facing the sheet bundle 1 is in contact with the uppermost sheet 1*a* of the sheet bundle 1. With the attraction belt 2 in contact with the uppermost sheet 1*a*, the Maxwell stress acts on the uppermost sheet 1*a*, which is a dielectric, owing to a non-uniform electric field generated by the charge patterns formed on the surface of the attraction belt 2. According to this action, the uppermost sheet 1*a* of the sheet bundle 1 is attracted to the attraction belt 2.

The attraction separation unit 110 stands by for a predetermined time in the state illustrated in FIG. 8D to attract the uppermost sheet 1*a* to the attraction belt 2. Then, the swing motor 30 is driven to drive the pinion gears 15 to rotate in the clockwise direction in the drawing, and the attraction separation unit 110 is swung around the support shaft 14 as a fulcrum in the counterclockwise direction in the drawing. According to this action, the downstream tension roller 5 moves together with the brackets 12 in the direction separating from the sheet bundle 1. By contrast, the weight of the upstream tension roller 6 keeps the upstream tension roller 6 pressed against the upper surface of the sheet bundle 1, and relatively moves toward the sheet bundle 1 relative to the brackets 12. According to this action, the attraction belt 2 makes a swinging motion around the rotation center of the upstream tension roller 6, and the uppermost sheet 1*a* attracted to the attraction belt 2 is bent at a portion of the attraction belt 2 wound around the upstream tension roller 6 as a fulcrum. As a result, resilience acts on the uppermost sheet 1*a* attracted to the attraction belt 2. According to this action, only the uppermost sheet 1*a* is attracted to the attraction belt 2, and the second sheet 1*b* is separated from the uppermost sheet 1*a* owing to the resilience of the uppermost sheet 1*a*.

Figure 8E:
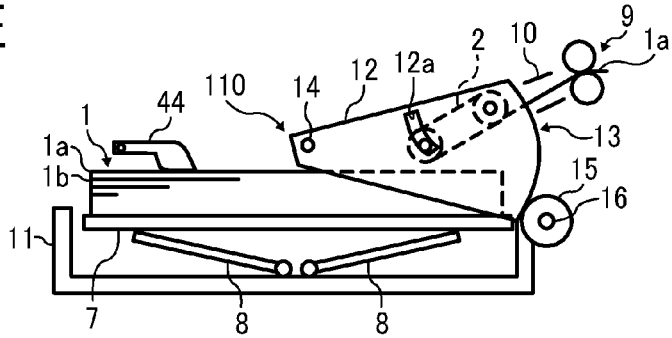

If the attraction separation unit 110 is further rotated around the support shaft 14 as a fulcrum in the counterclockwise direction in the drawing, the shaft 6*a* of the upstream tension roller 6 comes into contact with the lower ends 41 of the slits 12*a*. If the attraction separation unit 110 is further rotated in a state in which the shaft 6*a* of the upstream tension roller 6 is thus in contact with the lower ends 41 of the slits 12*a*, the upstream tension roller 6 moves together with the brackets 12 and separates from the upper surface of the sheet bundle 1. As illustrated in FIG. 8E, once the attraction separation unit 110 reaches the feed position for feeding a sheet, the driving of the swing motor 30 is stopped. Then, the drive motor 24 is driven to circularly move the attraction belt 2 and feed the uppermost sheet 1*a* attracted to the attraction belt 2 toward the feed roller pair 9. When the leading end of the uppermost sheet 1*a* electrostatically attracted to the attraction belt 2 reaches a portion of the attraction belt 2 wound around the downstream tension roller 5, the uppermost sheet 1*a* is separated from the attraction belt 2 owing to the curvature of the downstream tension roller 5, and is moved toward the feed roller pair 9 while being guided by the guide members 10, as illustrated in FIG. 8E.

The feed roller pair 9 and the attraction belt 2 are set to rotate at the same linear velocity. If the feed roller pair 9 is intermittently driven to adjust the feed timing, the drive motor 24 is controlled to also intermittently drive the attraction belt 2. Further, the drive mechanism 130 may be provided with an electromagnetic clutch to control the driving of the attraction belt 2.

The attraction belt 2 may be charged only by the length from the sheet separation position of the attraction belt 2 to the feed roller pair 9 and thereafter be discharged by the electrode member 3. This configuration allows the uppermost sheet 1*a* fed to the feed roller pair 9 to be thereafter fed solely by the feeding force of the feed roller pair 9 unaffected by the attraction belt 2. Further, the discharging of the attraction belt 2 suppresses electrostatic attraction of the second sheet 1*b* to the attraction belt 2, from which the second sheet 1*b* is separated.

In the present embodiment, the brackets 12 are provided with the respective slits 12*a*, and the shaft 6*a* of the upstream tension roller 6 engages the slits 12*a*. However, any other configuration may be employed which holds the upstream tension roller 6 to be swingable around the downstream tension roller 5 relative to the brackets 12, and which supports the upstream tension roller 6 such that the attraction belt 2 has a predetermined angle of tilt relative to the upper surface of the sheet bundle 1 when the attraction separation unit 110 is located at the feed position.

In the present embodiment, the uppermost sheet 1*a* is electrostatically attracted to the attraction belt 2 to be separated from the second sheet 1*b*. Therefore, multiple sheet feeding (i.e., feeding of a plurality of sheets in an overlapped manner) due to the influence of the coefficient of friction of sheets does not occur, unlike the configuration according to the separation method using frictional force.

In the present embodiment, gear meshing between the pinion gears 15 and the rack gear portions 13 causes the attraction separation unit 110 to swing. Therefore, the swing from the attraction position to the feed position and the swing from the feed position to the attraction position are both performed by the drive force of the swing motor 30. Thus, the attraction separation unit 110 is lowered to the attraction position faster than the speed of free fall thereof. After the feeding of the first sheet, therefore, the operation of attracting the next sheet is promptly started, and a reduction in the interval between the sheets is attained. Consequently, productivity is increased.

In the present embodiment, the swing mechanism 120 is provided on the downstream side in the sheet feeding direction at a position relatively distant from the support shaft 14 serving as the fulcrum of the attraction separation unit 110. According to this action, the downstream side of the attraction separation unit 110 in the sheet feeding direction is supported by the pinion gears 15 and the rack gear portions 13 meshing with each other. As a result, the opposite end portions of the attraction separation unit 110 are respectively supported by the support shaft 14 and the swing mechanism 120, and the vibration of the attraction separation unit 110 is minimized, as compared with a case where only one end of the attraction separation unit 110 is supported. This configuration suppresses the separation from the attraction belt 2 of the uppermost sheet 1*a* attracted thereto due to the vibration of the attraction separation unit 110. Further, at the downstream end portion of the attraction separation unit 110 in the sheet feeding direction, which is furthest from the support shaft 14 serving as the fulcrum of the attraction separation unit 110, the drive force is transmitted to the attraction separation unit 110 to swing the attraction separation unit 110. The portion for transmitting the drive force is thus set to a position relatively distant from the support shaft 14. According to the principle of the lever, therefore, the attraction separation unit 110 is swung with a relatively small load, as compared with a case where the drive force is transmitted on the side of the support shaft 14, i.e., the upstream side of the attraction separation unit 110 in the sheet feeding direction. Accordingly, an increase in size of the swing motor 30 is prevented, and thus an increase in size of the sheet feeder 200 is minimized. Further, abrasion of the meshing portions between the pinion gears 15 and the rack gear portions 13 is minimized.

Figure 9:
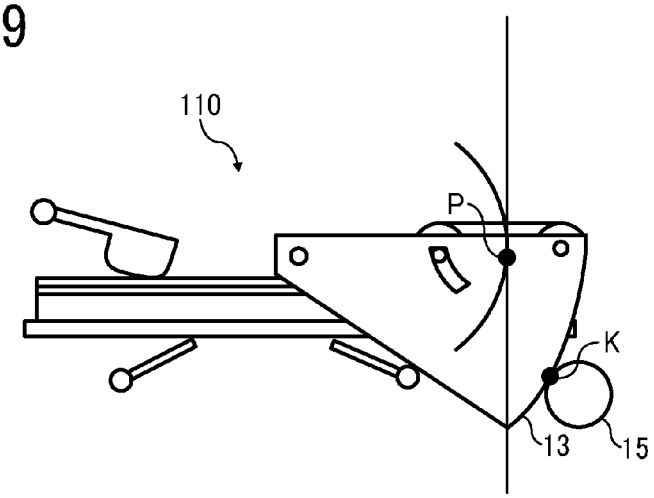
FIG. 9 is a diagram illustrating the relationship between the centroid of the attraction separation unit and a meshing position of a swing mechanism.

With the pinion gears 15 and the rack gear portions 13 provided to the downstream end portion of the attraction separation unit 110 in the sheet feeding direction, a meshing position K between the pinion gears 15 and the rack gear portions 13 is set to be downstream of a centroid P of the attraction separation unit 110 in the sheet feeding direction, as illustrated in FIG. 9. If the meshing position K is located upstream of the centroid P of the attraction separation unit 110 in the sheet feeding direction, the centroid P of the attraction separation unit 110 is located near a free end of the attraction separation unit 110 not supported by the support shaft 14 and the meshing portions of the swing mechanism 120, i.e., located downstream of the meshing position K in the sheet feeding direction. As a result, when the attraction separation unit 110 is swung, elastic vibration occurs in the free end of the attraction separation unit 110, i.e., the downstream end portion of the attraction separation unit 110 in the sheet feeding direction, in accordance with the distance between the meshing position K and the position of the centroid P owing to, for example, the inertia of the attraction separation unit 110. Further, with the position of the centroid P located near the free end, the amplitude is increased in the elastic vibration of the attraction separation unit 110, and the time taken for attenuation of the vibration is increased. By contrast, if the meshing position K is set to be downstream of the centroid P of the attraction separation unit 110 in the sheet feeding direction, as in the present embodiment, the elastic vibration occurs in the attraction separation unit 110, which is supported at the opposite end portions thereof. Accordingly, the amplitude of the vibration is reduced, and the time taken for attenuation of the vibration is reduced.

The position of the attraction separation unit 110 is retained by the pinion gears 15 and the rack gear portions 13 meshing with each other. If the swing motor 30 is accurately controlled, therefore, the position of the attraction separation unit 110 is accurately controlled. Accordingly, the attraction separation unit 110 is accurately set to the feed position. Particularly, in the present embodiment, the swing mechanism 120 is provided on the downstream side in the sheet feeding direction at a position relatively distant from the support shaft 14 serving as the fulcrum. Therefore, the amount of movement per pitch of the attraction separation unit 110 is less than in a case where the swing mechanism 120 is provided on the side of the support shaft 14, i.e., the upstream side in the sheet feeding direction. Thus, the position of the attraction separation unit 110 is controlled with higher accuracy. As a result, the attraction separation unit 110 is accurately set to the intended feed position, and the uppermost sheet 1*a* is smoothly fed to the feed roller pair 9. Accordingly, the leading end of the uppermost sheet 1*a* is prevented from bumping against the feed roller pair 9 and causing vibration resulting in separation of the uppermost sheet 1*a* from the attraction belt 2.

Figure 10:
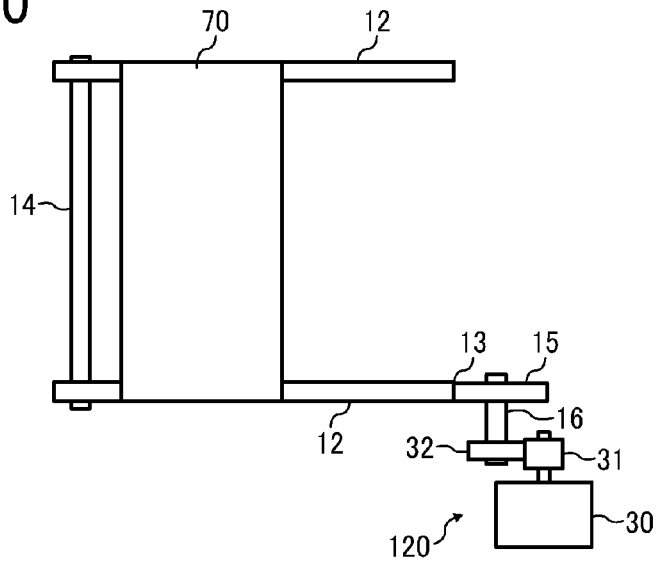
FIG. 10 is a diagram illustrating a configuration having a rack and pinion mechanism provided only to one end of the attraction separation unit in a belt width direction.

Provided with the rack gear portions 13 and the pinion gears 15, the opposite end portions of the attraction separation unit 110 in the belt width direction are supported by the rack gear portions 13 and the pinion gears 15 meshing with each other. According to this action, twisting of the attraction separation unit 110 is minimized. As illustrated in FIG. 10, the rack and pinion mechanism may be provided only to one of the opposite end portions of the attraction separation unit 110 in the belt width direction.

Figure 11:
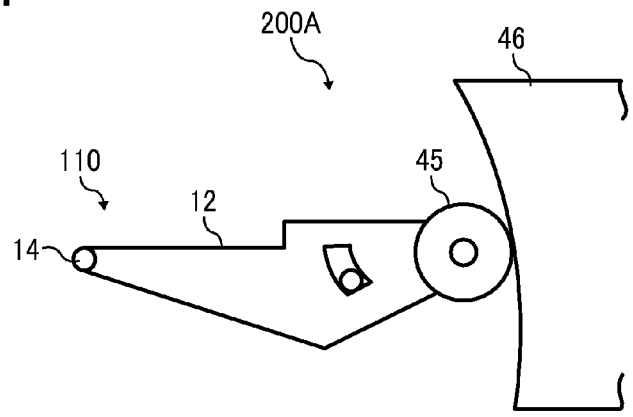
FIG. 11 is a schematic configuration diagram of a sheet feeder according to a first modified example.
Figure 12:
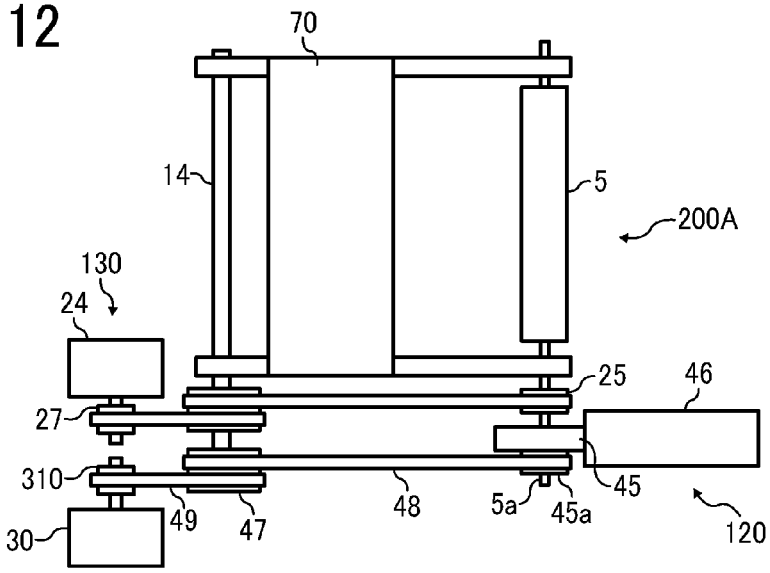
FIG. 12 is a schematic configuration diagram of a drive mechanism and a swing mechanism of the sheet feeder according to the first modified example.

Modified examples of the present embodiment will now be described. A first modified example will be first described. FIG. 11 is a schematic configuration diagram illustrating a sheet feeder 200A according to the first modified example. FIG. 12 is a schematic configuration diagram illustrating the drive mechanism 130 and the swing mechanism 120 of the sheet feeder 200A according to the first modified example. The illustration of the attraction belt 2 and so forth is omitted in FIG. 12.

As illustrated in FIG. 11, in the sheet feeder 200A according to the first modified example, a rack and pinion of the swing mechanism 120 includes a pinion gear 45 provided to one of the brackets 12 and a rack gear 46 provided to the body of the sheet feeder 200A. As illustrated in FIG. 12, the pinion gear 45 is rotatably supported by the shaft 5*a* of the downstream tension roller 5. The pinion gear 45 is provided with a pulley portion 45*a*, and a first timing belt 48 is wound around the pulley portion 45*a* and a driven pulley 47 provided to the support shaft 14. Further, a second timing belt 49 is wound around the driven pulley 47 and a drive pulley 310 provided to the motor shaft of the swing motor 30. With this configuration, the drive force of the swing motor 30 is transmitted to the pinion gear 45 via the support shaft 14. Similarly as in the above-described drive mechanism 130, therefore, the drive force of the swing motor 30 is favorably transmitted to the pinion gear 45, with the first timing belt 48 not sagging owing to the swing of the attraction separation unit 110.

The configuration having the pinion gear 45 provided to the attraction separation unit 110, as in the first modified example, is advantageous in a case where the amount of swing of the attraction separation unit 110 is relatively large. That is, while a rack gear is desired to be increased in size in accordance with the amount of swing of the attraction separation unit 110, a pinion gear may be set to a fixed size regardless of the amount of swing of the attraction separation unit 110. Therefore, an increase in size of the attraction separation unit 110 is prevented, and an increase in the load during the swing of the attraction separation unit 110 due to an increase in weight thereof is minimized. If the amount of swing is relatively large, therefore, the configuration of the first modified example may be employed to increase the swing speed of the attraction separation unit 110 and thereby increase productivity.

Figure 13:
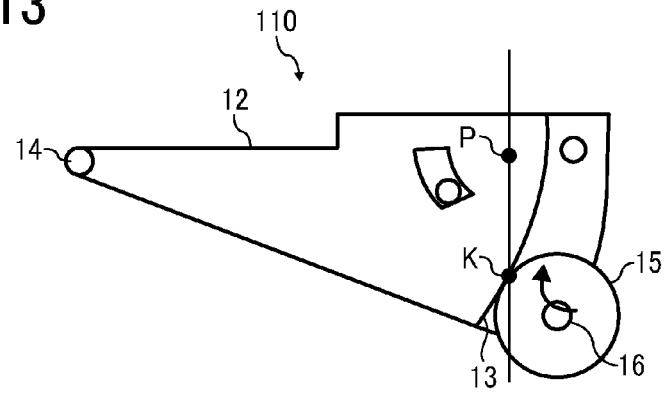
FIG. 13 is a schematic configuration diagram of a sheet feeder according to a second modified example.
Figure 14:
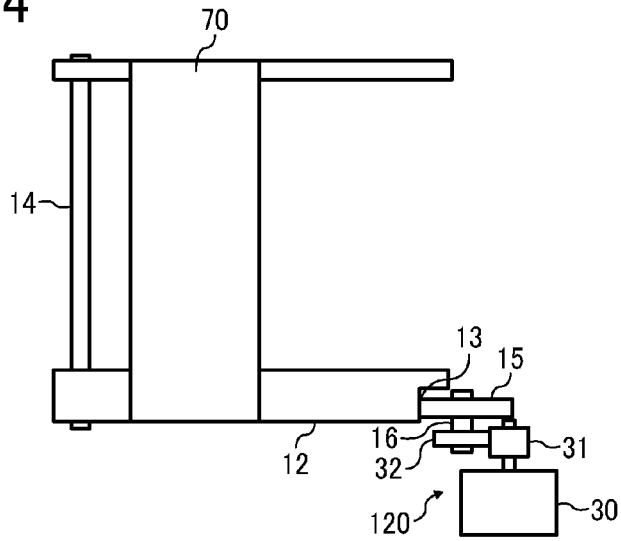
FIG. 14 is a schematic configuration diagram of a swing mechanism of the sheet feeder according to the second modified example.

A second modified example will now be described. FIG. 13 is a schematic configuration diagram of a sheet feeder 200B according to the second modified example. FIG. 14 is a schematic configuration diagram of the swing mechanism 120 of the sheet feeder 200B according to the second modified example. In the sheet feeder 200B according to the second modified example, the position of the centroid P of the attraction separation unit 110 located at the feed position and the meshing position K between the rack gear portion 13 and the pinion gear 15 of the swing mechanism 120 are set to the same position in the sheet feeding direction. In the second modified example, to cause the position of the centroid P of the attraction separation unit 110 located at the feed position and the meshing position K between the rack gear portion 13 and the pinion gear 15 of the swing mechanism 120 to be set to the same position in the sheet feeding direction, the downstream end portion of one of the brackets 12 in the sheet feeding direction is provided with a step portion provided with the rack gear portion 13 as illustrated in FIG. 14.

When the attraction separation unit 110 is stopped at the feed position, elastic vibration occurs in the attraction separation unit 110 owing to the inertia thereof. Particularly when the attraction separation unit 110 is swung at relatively high speed to increase productivity, the elastic vibration tends to be increased by the increased influence of the inertia of the attraction separation unit 110. The elastic vibration of the attraction separation unit 110 at the feed position may cause the uppermost sheet 1*a* attracted to the attraction belt 2 to separate from the attraction belt 2. In view of this, the second modified example is configured such that the position of the centroid P of the attraction separation unit 110 located at the feed position and the meshing position K between the rack gear portion 13 and the pinion gear 15 of the swing mechanism 120 are set to the same position in the sheet feeding direction. According to this action, the elastic vibration occurring when the attraction separation unit 110 is stopped at the feed position is highly effectively minimized, and the separation of the uppermost sheet 1*a* from the attraction belt 2 is minimized.

Figure 15:
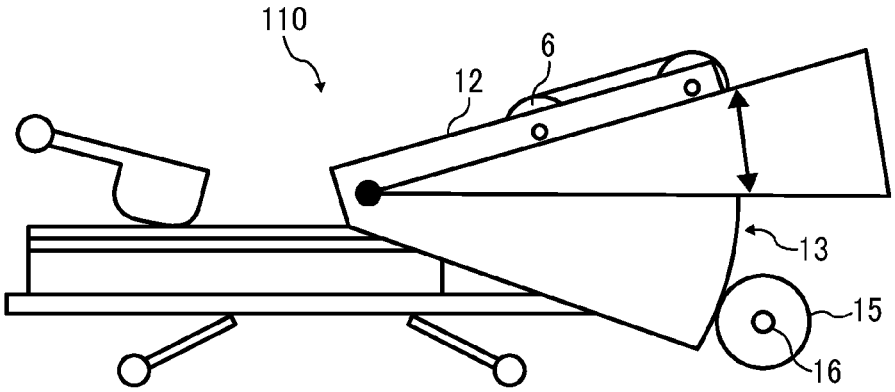
FIG. 15 is a schematic configuration diagram of a sheet feeder according to a third modified example.

A third modified example will now be described. FIG. 15 is a schematic configuration diagram of a sheet feeder 200C according to the third modified example. As illustrated in the drawing, in the sheet feeder 200C according to the third modified example, the upstream tension roller 6 is configured to be immovable relative to the brackets 12, and the feed position of the attraction separation unit 110 is changed in accordance with conditions such as the sheet thickness.

Figure 16:
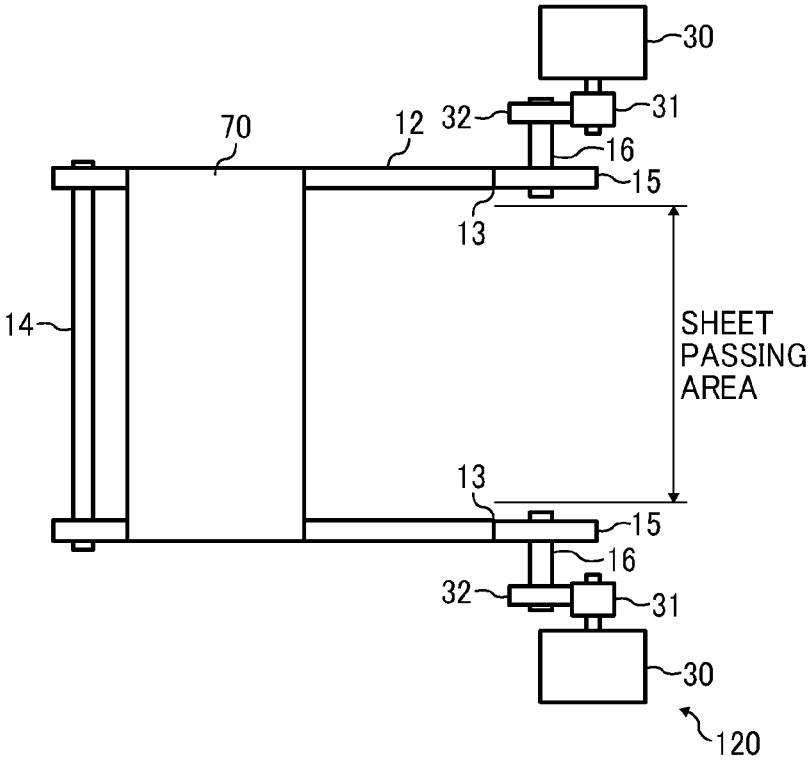
FIG. 16 is a diagram illustrating another example of a swing mechanism of the sheet feeder according to the third modified example.

In the configuration that holds the upstream tension roller 6 to be swingable around the downstream tension roller 5 relative to the brackets 12, and in which the shaft 6*a* of the upstream tension roller 6 is in contact with the lower ends 41 of the slits 12*a* when the attraction separation unit 110 is located at the feed position, the angle of tilt of the attraction belt 2 formed relative to the sheet bundle 1 in the feeding process is fixed. For example, therefore, in the case of a sheet having relatively high resilience, such as a relatively thick sheet, the uppermost sheet 1*a* may separate from the attraction belt 2. In view of this, the third modified example supports the upstream tension roller 6 to be immovable relative to the brackets 12, and changes the range of swing of the attraction separation unit 110 in accordance with conditions, such as the sheet thickness, to change the feed position of the attraction separation unit 110. In this case, if the rotary shaft 16 for fixing the pinion gears 15 is located in the range of swing of the attraction separation unit 110 corresponding to the encircled area indicated by a double-headed arrow in FIG. 15, the rotary shaft 16 may obstruct the feeding operation, depending on the feed position. In this case, therefore, it is desired to provide the rotary shaft 16 outside the range of swing of the attraction separation unit 110, as illustrated in FIG. 15. Further, as illustrated in FIG. 16, the swing motor 30 may be provided to each of the opposite end portions of the attraction separation unit 110 in the belt width direction. In this configuration, the swing mechanism 120 does not obstruct the feeding operation.

As described above, the sheet feeder 200 according to the present embodiment includes the attraction separation unit 110 including the attraction belt 2 that is disposed to face the upper surface of the stacked sheet bundle 1 to attract the uppermost sheet 1*a* of the sheet bundle 1. The attraction separation unit 110 is rotatably supported at a position upstream of the attraction belt 2 in the sheet feeding direction. The sheet feeder 200 further includes the swing mechanism 120 serving as the swing device that swings the attraction separation unit 110 around the upstream position in the sheet feeding direction as a fulcrum to move the attraction belt 2 back and forth between the attraction position for attracting the uppermost sheet 1*a* of the sheet bundle 1 and the feed position for feeding the uppermost sheet 1*a*, which is more distant from the sheet bundle 1 than the attraction position is. The swing mechanism 120 includes at least one first drive transmitting portion attached to the downstream end portion of the attraction separation unit 110 in the sheet feeding direction and one second drive transmitting portion attached to the body of the sheet feeder 200 and meshing with the first drive transmitting portion. The first drive transmitting portion and the second drive transmitting portion mesh with each other to swing the attraction separation unit 110. As described above, this configuration allows both ends of the attraction separation unit 110 to be supported during the swing of the attraction separation unit 110, and suppresses the vibration of the attraction separation unit 110. Further, the configuration allows the meshing position between the first drive transmitting portion and the second drive transmitting portion to be set to a position relatively distant from the fulcrum of the attraction separation unit 110. Thus, the load on the swing mechanism 120 is reduced. Accordingly, an increase in size of the swing motor 30 is prevented, and the abrasion of the meshing portion between the first drive transmitting portion and the second drive transmitting portion is minimized.

In the attraction separation unit 110, the attraction belt 2 is stretched between two tension rollers. The two tension rollers include the upstream tension roller 6 located on the upstream side in the sheet feeding direction and supported to be movable in a direction perpendicular to the upper surface of the sheet bundle 1 in a predetermined range. According to this action, the sheet separation using the resilience of sheets is performed, and favorable separation performance is obtained. Further, the attraction belt 2 is separated from the upper surface of the sheet bundle 1 simply by the swing of the attraction separation unit 110.

The attraction separation unit 110 includes at least one bracket 12 rotatably supporting the downstream and upstream tension rollers 5 and 6 and having a downstream end portion in the sheet feeding direction formed with the first drive transmitting portion. This configuration reduces the number of components and the cost of the sheet feeder 200, as compared with a case where the bracket 12 and the first drive transmitting portion are formed as separate members. The configuration further reduces the weight of the attraction separation unit 110 and the load imposed during the swing of the attraction separation unit 110. Further, the configuration reduces the inertia of the attraction separation unit 110, and thus suppresses the elastic vibration occurring when the attraction separation unit 110 is stopped at the feed position.

The present embodiment is configured such that one of the first drive transmitting portion and the second drive transmitting portion forms a rack and the other one of the first drive transmitting portion and the second drive transmitting portion forms a pinion, and that the drive force of the swing motor 30 serving as a drive source is transmitted to the pinion. This configuration makes it relatively easy to provide a configuration that swings the attraction separation unit 110 in accordance with the meshing between the first drive transmitting portion and the second drive transmitting portion.

The rack is formed into a substantially circular arc shape centering around a position upstream of the first drive transmitting portion and the second drive transmitting portion in the sheet feeding direction. According to this action, disengagement of the mutually meshing first and second drive transmitting portions is minimized during the swing of the attraction separation unit 110. Specifically, with the rack formed into a substantially circular arc shape centering around the fulcrum of the attraction separation unit 110, the disengagement of the mutually meshing first and second drive transmitting portions is prevented during the swing of the attraction separation unit 110.

If the first drive transmitting portion and the second drive transmitting portion form the rack and the pinion, respectively, the mechanism for transmitting the drive to the pinion is simplified.

If the first drive transmitting portion is provided downstream of the position of the centroid P of the attraction separation unit 110 in the sheet feeding direction, the elastic vibration occurs in the attraction separation unit 110, which is supported at the opposite end portions thereof. Accordingly, the amplitude of the vibration is reduced, and the time taken for attenuation of the vibration is reduced. This configuration therefore suppresses the separation from the attraction belt 2 of the uppermost sheet 1*a* attracted thereto due to the vibration of the attraction separation unit 110.

If the meshing position K between the first drive transmitting portion and the second drive transmitting portion and the position of the centroid P of the attraction separation unit 110 located at the feed position are set to the same position in the sheet feeding direction, the elastic vibration of the attraction separation unit 110 occurring when the attraction separation unit 110 is stopped at the feed position is effectively minimized.

If the first drive transmitting portion and the second drive transmitting portion are provided to each of the opposite end portions of the attraction separation unit 110 in the belt width direction, the opposite end portions of the downstream end portion of the attraction separation unit 110 in the belt width direction are supported by the first drive transmitting portion and the second drive transmitting portion meshing with each other, and thus twisting of the attraction separation unit 110 is minimized. This configuration therefore suppresses the separation of the uppermost sheet 1*a* from the attraction belt 2 due to twisting of the attraction belt 2 resulting from the twisting of the attraction separation unit 110.

The first and second drive transmitting portions provided to one of the opposite end portions of the attraction separation unit 110 in the belt width direction and the first and second drive transmitting portions provided to the other one of the opposite end portions of the attraction separation unit 110 in the belt width direction are supplied with the drive force from the common drive source. This configuration reduces the number of components and the cost of the sheet feeder 200, as compared with a case where the drive force is supplied by different drive sources on the one end portion and the other end portion of the attraction separation unit 110.

The second drive transmitting portion provided to the one of the opposite end portions of the attraction separation unit 110 in the belt width direction and the second drive transmitting portion provided to the other one of the opposite end portions of the attraction separation unit 110 in the belt width direction are supported by the common rotary shaft 16 disposed outside the range between the attraction position and the feed position. This configuration prevents the rotary shaft 16 from obstructing the feeding operation.

The image forming apparatus according to the present embodiment uses the above-described sheet feeder 200. Accordingly, productivity is increased, and a sheet feeding failure, such as multiple sheet feeding, is minimized.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A sheet feeder, comprising:

an attraction separation unit including an attraction belt stretched around two tension rollers, disposed facing the upper surface of a stacked sheet bundle to attract an uppermost sheet of the sheet bundle and rotatably supported by a support member at a position upstream of the attraction belt in a sheet feeding direction; and a swing device to swing the attraction separation unit around the support member as a fulcrum to move the attraction belt back and forth between an attraction position for attracting the uppermost sheet of the sheet bundle to the attraction belt and a feed position for feeding the uppermost sheet attracted to the attraction belt further from the sheet bundle than the attraction position, wherein:

the swing device includes an assembly of a first drive transmitting portion and a second drive transmitting portion, with the first drive transmitting portion attached to a downstream end portion of the attraction separation unit in the sheet feeding direction and the second drive transmitting portion attached to the body of the sheet feeder and connected with the first drive transmitting portion, the first drive transmitting portion and the second drive transmitting portion are connected with each other transmitting a driving force therebetween, thereby swinging the attraction separation unit, one of the first drive transmitting portion and the second drive transmitting portion forms a rack, and the other one of the first drive transmitting portion and the second drive transmitting portion forms a pinion, and the pinion receives drive force of a drive source transmitted thereto.

2. The sheet feeder according to claim 1, wherein an upstream one of the two tension rollers in the sheet feeding direction is movable in a direction perpendicular to the upper surface of the sheet bundle.

3. The sheet feeder according to claim 2, wherein the attraction separation unit includes a bracket configured to rotatably support the tension rollers and a downstream end portion of the bracket in the sheet feeding direction serves as the first drive transmitting portion.

4. The sheet feeder according to claim 1, wherein the rack is formed into a substantially circular arc shape centering around a position upstream of the first drive transmitting portion and the second drive transmitting portion in the sheet feeding direction.

5. The sheet feeder according to claim 4, wherein the rack is formed into a substantially circular arc shape centering around the fulcrum of the attraction separation unit.

6. The sheet feeder according to claim 1, wherein the first drive transmitting portion forms the rack, and the second drive transmitting portion forms the pinion.

7. The sheet feeder according to claim 1, wherein a connecting position between the first drive transmitting portion and the second drive transmitting portion is disposed downstream of the centroid of the attraction separation unit in the sheet feeding direction.

8. The sheet feeder according to claim 7, wherein the connecting position between the first drive transmitting portion and the second drive transmitting portion and the centroid of the attraction separation unit located at the feed position are at the same position in the sheet feeding direction.

9. The sheet feeder according to claim 1, wherein the assemblies of the first drive transmitting portion and the second drive transmitting portion are provided to each of lateral opposite end portions of the attraction separation unit at lateral ends of the attraction belt.

10. The sheet feeder according to claim 9, wherein each assembly of the first drive transmitting portion and the second drive transmitting portion provided to each of lateral opposite end portions of the attraction separation unit at lateral ends of the attraction belt are driven by a common drive source.

11. The sheet feeder according to claim 10, wherein the second drive transmitting portion provided to the one of the opposite end portions of the attraction separation unit in the width direction of the attraction belt and the second drive transmitting portion provided to the other one of the lateral opposite end portions of the attraction separation unit in the width direction of the attraction belt are supported by a common rotary shaft disposed outside the range between the attraction position and the feed position of the attraction belt.

12. The sheet feeder according to claim 1, wherein an upstream one of the two tension rollers in the sheet feeding direction is immovable in a direction perpendicular to the upper surface of the sheet bundle.

13. An image forming apparatus, comprising:

an image forming device to form an image on a sheet; and a sheet feeder according to claim 1 to separate an uppermost sheet from a stacked sheet bundle and feed the uppermost sheet to the image forming device.

* * * * *